US008523661B2

(12) United States Patent
Pires

(10) Patent No.: US 8,523,661 B2
(45) Date of Patent: Sep. 3, 2013

(54) GAMING MACHINE, LINKED GAMING SYSTEM AND METHOD WITH VARIABLE ELIGIBILITY FOR AN AWARD

(75) Inventor: Claudio Daniel Dias Pires, Bonnyrigg Heights (AU)

(73) Assignee: Aristocrat Technologies Australia Pty Ltd. (AU)

( * ) Notice: Subject to any disclaimer, the term of this patent is extended or adjusted under 35 U.S.C. 154(b) by 1078 days.

(21) Appl. No.: 12/118,467

(22) Filed: May 9, 2008

(65) Prior Publication Data

US 2009/0069080 A1 Mar. 12, 2009

(30) Foreign Application Priority Data

Jun. 20, 2007 (AU) ..... 2007903310

(51) Int. Cl.
*A63F 9/24* (2006.01)

(52) U.S. Cl.
USPC ..... 463/25

(58) Field of Classification Search
USPC ..... 463/25, 42
See application file for complete search history.

(56) References Cited

U.S. PATENT DOCUMENTS

| | | | | |
|---|---|---|---|---|
| 5,580,309 | A | 12/1996 | Piechowiak et al. | |
| 6,210,275 | B1 * | 4/2001 | Olsen | 463/16 |
| 6,231,445 | B1 * | 5/2001 | Acres | 463/42 |
| 6,435,968 | B1 * | 8/2002 | Torango | 463/27 |
| 6,733,390 | B2 * | 5/2004 | Walker et al. | 463/23 |
| 2001/0036857 | A1 * | 11/2001 | Mothwurf et al. | 463/25 |
| 2005/0079908 | A1 * | 4/2005 | Pacey | 463/20 |
| 2006/0258424 | A1 * | 11/2006 | Green | 463/16 |
| 2010/0190543 | A1 * | 7/2010 | Englman et al. | 463/20 |

FOREIGN PATENT DOCUMENTS

EP 0984408 A2 * 8/1999 ..... 17/32

OTHER PUBLICATIONS

Bueschel, Richard M., Slot Machines: A Pictorial Review, 1976, Vestal Press, pp. 98-99.*

* cited by examiner

*Primary Examiner* — Corbett B Coburn
(74) *Attorney, Agent, or Firm* — McAndrews, Held & Malloy, Ltd.

(57) ABSTRACT

A method of awarding an award on a gaming machine is set forth. The method includes selecting an eligibility criterion or eligibility criteria from a plurality of possible eligibility criteria. The selected criterion is deemed to be an active award trigger event. Game play activity on the gaming machine is then monitored for occurrence of this trigger event. When the active award trigger event occurs, the award is awarded. Following award of the award, or following the occurrence of another event, the selected eligibility criterion are rendered inactive award trigger event, and another eligibility criterion is selected as the active award trigger event.

16 Claims, 5 Drawing Sheets

GAMING MACHINE, LINKED GAMING SYSTEM AND METHOD WITH VARIABLE ELIGIBILITY FOR AN AWARD

CROSS-REFERENCE TO RELATED APPLICATIONS

This application claims priority to Australian Provisional Patent Application No. 2007903310, having an international filing date of Jun. 20, 2007, entitled "Gaming machine, linked gaming system and method with variable eligibility for an award," which is hereby incorporated by reference herein in its entirety.

FIELD OF THE INVENTION

The present invention generally relates to the awarding of prizes on gaming machines. A particular embodiment of the present invention relates to the award of prizes on a system of linked gaming machines. Another embodiment relates to the award of prizes on individual or standalone gaming machines.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming machines, devices and systems have attempted to provide the sought after variety, while still developing games that comply with the relevant regulations in the jurisdiction of the gaming venue operator. Suppliers of gaming devices therefore are faced with restrictions on the types of games and gaming machines that are allowable, both in terms of the prevailing regulations and in terms of providing a return on investment to the gaming venue operators.

Despite these restrictions, gaming machine suppliers have had some success in developing different mechanisms for awarding awards.

One example of an award mechanism is a mystery progressive jackpot, in which a plurality of linked gaming machines contribute to a progressive jackpot until the value of the jackpot reaches a certain 'trigger' amount. The trigger amount is typically randomly determined within a fixed range. The progressive jackpot is then awarded to the gaming machine that caused the jackpot to reach or exceed the trigger amount.

There remains a need in the gaming machine industry to provide alternative award mechanisms.

Any reference in this specification to the prior art does not constitute an admission that such prior art was well known or forms part of the common general knowledge in any jurisdiction.

SUMMARY OF THE INVENTION

According to a first aspect, the invention broadly resides in a method of awarding an award on a gaming machine, the method including:

a) in a random selection process selecting an eligibility criterion or eligibility criteria from a plurality of possible eligibility criteria, whereby the selected criterion or criteria is deemed an active award trigger event;

b) monitoring game play activity on the gaming machine for occurrence of the active award trigger event;

c) when the active award trigger event occurs as a result of game play activity on the gaming machine, awarding the award; and d) following the completion of step c), or following the occurrence of another event:

i) deeming the selected eligibility criterion or criteria an inactive award trigger event; and ii) repeating steps a) to c).

In one embodiment, the method is implemented on a gaming machine that forms one of a plurality of linked gaming machines, and the method further includes communicating the active award trigger event to the linked gaming machines, monitoring each of the gaming machines for occurrence of the active award trigger event, performing process c) only for the first of the gaming machines to achieve the active award trigger event and performing process d) following the award of the award by any of the gaming machines. In this embodiment, the method may further include displaying information reporting the active award trigger event on a display of each of the linked gaming machines.

In an alternative embodiment, the method is implemented on an individual gaming machine, which may be a standalone gaming machine. In this embodiment, the method may further include displaying information reporting the active award trigger event on a display of the gaming machine.

According to a second aspect, the invention broadly resides in a method for use with a plurality of linked gaming machines, the method including:

a) forming a group of gaming machines from the plurality of linked gaming machines;

b) in a random selection process selecting an eligibility criterion or eligibility criteria from a plurality of possible eligibility criteria, whereby the selected criterion or criteria is deemed an active award trigger event, and communicating the active award trigger event to a group of the linked gaming machines;

c) monitoring game play activity on the group of gaming machines for occurrence of the active award trigger event;

d) when the active award trigger event occurs as a result of game play activity on one of the gaming machines in the group, awarding the award to that gaming machine; and e) following the completion of step d), or following the occurrence of a change event:

i) deeming the selected eligibility criterion or criteria an inactive award trigger event for the group of gaming machines; and ii) repeating at least steps b) to d).

In one embodiment, the group of gaming machines includes all of the plurality of linked gaming machines. In another embodiment, the group of gaming machines are selected from within the plurality of linked gaming machines. In this other embodiment, the method may comprise performing processes a) to e) individually for different groups of gaming machines within the plurality of linked gaming machines.

In one embodiment of the first or second aspects, sub-step i) is performed substantially immediately following the award of the award.

In one embodiment of the first or second aspects, sub-step ii) is performed substantially immediately following the award of the award. In another embodiment, the method includes delaying the performance of sub-step ii) following the award of the award.

In one embodiment of the first or second aspects, the change event is the elapsing of a certain time interval without occurrence of the active award trigger event.

In one embodiment of the first or second aspects, the plurality of possible eligibility criteria varies over time. In this embodiment, the variation may be in a predetermined pattern. Alternatively, the variation may include at least a component that is random. Events that cause the variation may be any one or more of: the elapsing of a certain period of time; the occurrence of a change trigger event based on game activity of the gaming machine or based on other criteria; and receipt of a change input at an operator interface.

In one embodiment of the first or second aspects, the award is a feature game that operates over a plurality of game events. In another embodiment, the award is a special prize selected from the group including a progressive prize, a non-cash prize and a large prize. In one embodiment, the award is a progressive prize.

In one embodiment of the first or second aspects, the award remains the same for a plurality of consecutive selections of active award trigger events. The award may remain the same for all selections of active award trigger events. In another embodiment, the award that is awarded may differ over time. In this other embodiment, the variation may occur according to a predefined pattern, according to a random selection process, or as a result of a manual input.

In one embodiment of the first or second aspects, one criterion in the plurality of possible eligibility criteria includes the occurrence of a certain symbol or combination of symbols during play of a game. In this embodiment, all or substantially all of the possible eligibility criteria may comprise the occurrence of a certain symbol or combination of symbols, wherein at least one of the symbols that must occur and the manner in which the symbols must occur is different between different possible eligibility criteria.

In one embodiment of the first or second aspects, different possible eligibility criteria have different probabilities of occurrence.

In one embodiment of the first aspect when the gaming machine is one of a plurality of linked gaming machines or in one embodiment of the second aspect, one or more of the possible eligibility criteria have a different probability of occurrence on different gaming machines. In this embodiment, at least one of the collective characteristics of the plurality possible eligibility criteria and the selection process may be adapted so that the method contributes a substantially equal amount to the expected return to player of the linked gaming machines.

According to a third aspect, the invention broadly resides in a gaming machine including:

a game controller including a computational device and data storage in communication with the computational device; and a user interface including at least one display and one or more input devices in communication with the game controller;

wherein the data storage includes a definition of a plurality of possible eligibility criteria, each defining a circumstance that arises during play of a game on the gaming machine;

wherein the game controller selects, using a random selection process, one or more of the plurality of possible eligibility criteria to thereby define at least one award trigger event, and monitors play of the game on the gaming machine for occurrence of the award trigger event;

wherein when the award trigger event occurs, the game controller causes the gaming machine to award an award.

According to a fourth aspect, the invention broadly resides in a gaming system including a plurality linked gaming machines, each gaming machine including a communication interface for communicating with the gaming system, and a game controller and a user interface for providing a game in which a plurality of symbols are selected and presented on a display of the user interface and if a winning combination occurs, the gaming machine awards an award, wherein the gaming system further includes an award controller that selects, using a random selection process, one or more of a plurality of possible eligibility criteria and communicates the selection to the game controller of each of the linked gaming machines, wherein the game controller of each linked gaming machine uses the selection as a definition of an award trigger event and identifies when a said award trigger event occurs, and in response controls the communication interface to send a notice of the occurrence of the award trigger event to the gaming system.

In one embodiment of the fourth aspect, the notice is received by the award controller, which then communicates a second notice to each of the linked gaming machines.

In one embodiment of the third and fourth aspects, following the occurrence of one or more predefined events the game controller or award controller respectively again selects, using a random selection process, one or more of the plurality of possible eligibility criteria to thereby define a new award trigger event, so that the at least one award trigger event is variable. The one or more predefined events may comprise events selected from the group of: the occurrence of the current award trigger event; a time-based event, the occurrence of which is dictated according to either determinative or random criteria; receipt by the game controller or award controller of a predefined command; and a combination thereof. The game controller or award controller may delay the selection process for a delay period following occurrence of the one or more predefined events.

In one embodiment of the third and fourth aspects in different selections of one or more of the plurality of possible eligibility criteria to define at least one award trigger event, the selection is made from different sets of possible eligibility criteria. The change in the sets may occur in a predetermined pattern. Alternatively, the change may include at least a component that is varied randomly. Events that cause the variation may be any one or more of: the elapsing of a certain period of time; the occurrence of a change trigger event based on game activity of the gaming machine or based on other criteria; the provision by the player of a particular wager, for example the staking of an ante-bet, and receipt of a change input at an operator interface of a device in direct or indirect communication with the gaming machine.

In one embodiment of the third and fourth aspects, the award is a feature game that operates over a plurality of game events. In another embodiment, the award is a special prize selected from the group including a progressive prize, a non-cash prize and a large prize. In one embodiment, the award is a progressive prize. The award may remain the same, or may vary for different occurrences of the award trigger event.

In one embodiment of the third and fourth aspects, different possible eligibility criteria have different probabilities of occurrence.

In one embodiment of the third and fourth aspects, the game controller or award controller controls a said display to display information that reports to a player of the gaming machine the at least one award trigger event.

According to a fifth aspect, the invention broadly resides in instructions executable by a game controller or instructions to form a programmed game controller, to implement the method as described in the preceding paragraphs and to such instructions when stored in electronic storage.

Further aspects of the present invention and further embodiments of the aspects described in the preceding paragraphs will become apparent from the following description, given by way of example only and with reference to the accompanying drawings.

Figure 1:
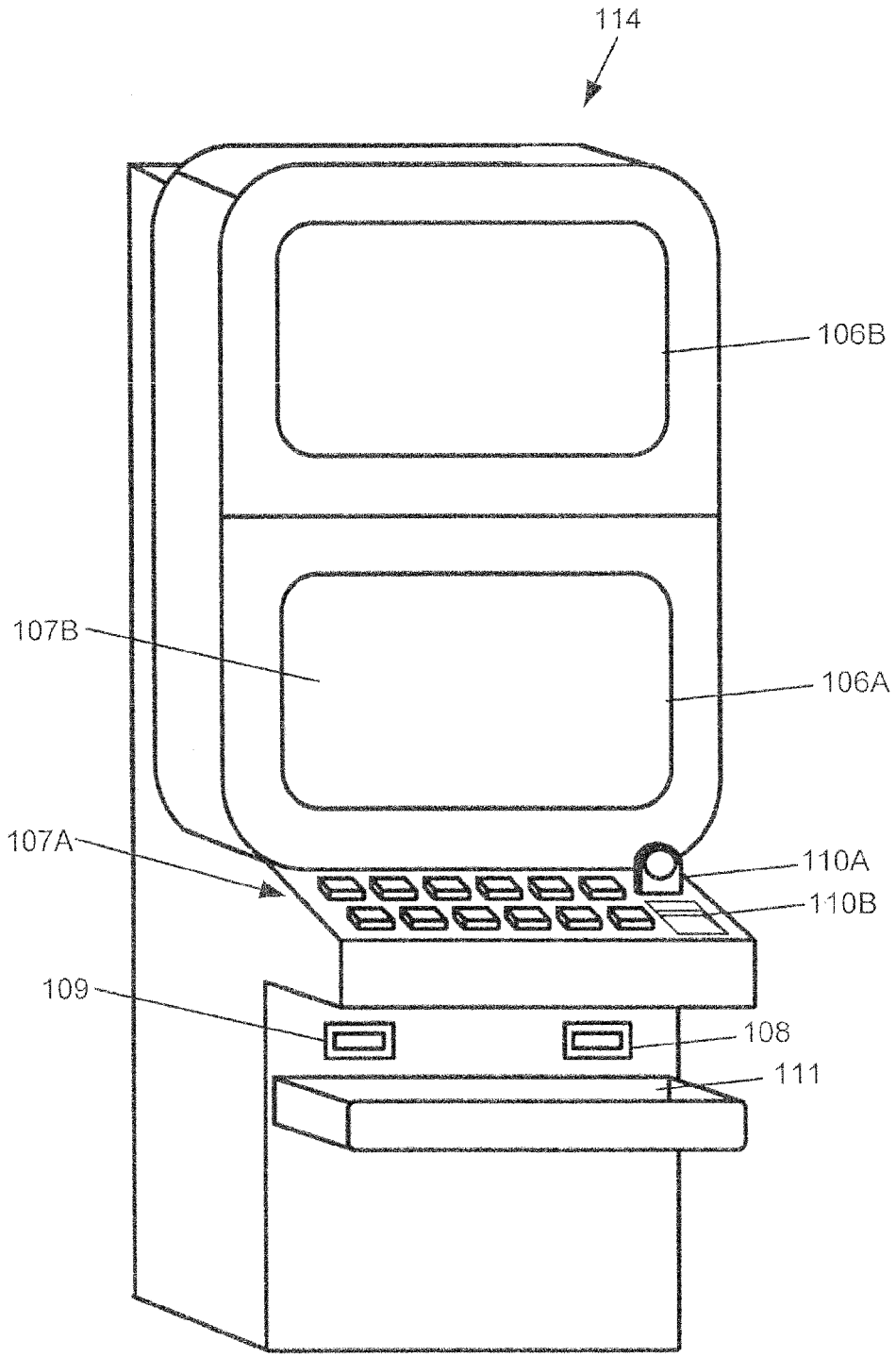
FIG. 1: shows diagrammatically, a view of a gaming console suitable for implementing certain embodiments of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

In FIG. 1 of the accompanying drawings, one example of a gaming console that is suitable to implement certain embodiments of the present invention is generally referenced by arrow 114.

The gaming console 114 includes two displays 106A, 106B on one or both of which is displayed representations of a game that can be played by a player and a bank of buttons 107A and/or a touch screen 107B to enable a player to play the game. The displays 106 may be video display units, such as a cathode ray tube screen device, a liquid crystal display, plasma screen, any other suitable video display unit, or the visible portion of an electromechanical device. The display 106B may display artwork, including for example, pay tables and details of bonus awards and other information or images relating to the game. In alternative gaming consoles the display 106B may be omitted, optionally replaced by a static display.

A credit input including a coin input 110A and/or bill collector 110B allows a player to provide credit for wagering and a coin output 111 is provided for cash payouts from the gaming console 114. A card and/or ticket reader 108 and a printer 109 may be provided to provide player tracking, cashless game play or other gaming and non-gaming related functions.

Figure 2:
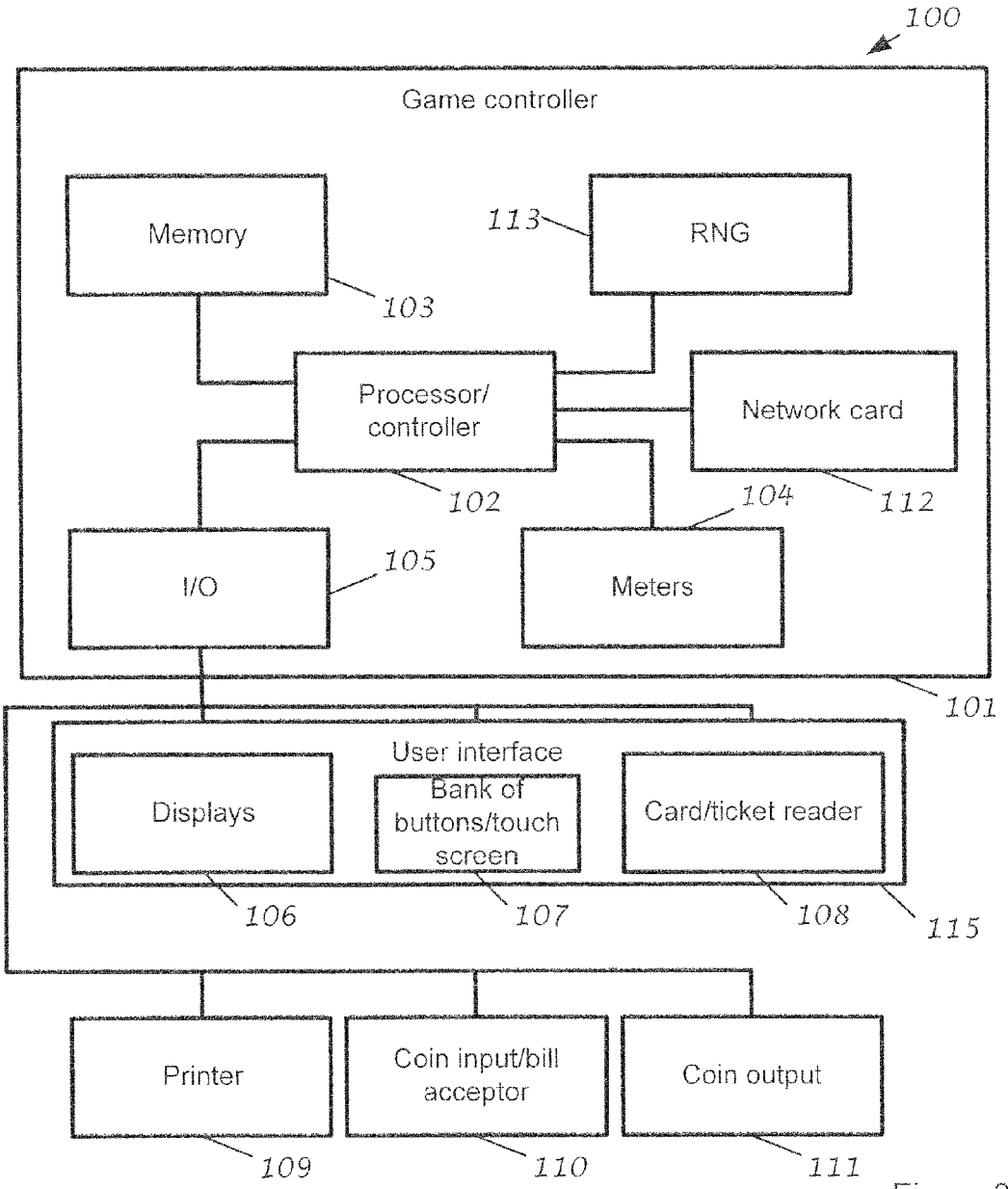
FIG. 2: shows a block diagram of gaming machine suitable for implementing certain embodiments of the present invention.

FIG. 2 shows a block diagram of a gaming machine, generally referenced by arrow 100, suitable for implementing certain embodiments of the present invention. The gaming machine 100 may include the gaming console 114 shown in FIG. 1 and accordingly like reference numerals have been used to describe like components in FIGS. 1 and 2.

The gaming machine 100 includes a game controller 101, which in the illustrated example includes a computational device 102, which may be a microprocessor, microcontroller, programmable logic device or other suitable device. Instructions and data to control operation of the computational device 102 are stored in a memory 103, which is in data communication with, or forms part of, the computational device 102. Typically, the gaming machine 100 will include both volatile and non-volatile memory and more than one of each type of memory, with such memories being collectively represented by the memory 103. The instructions to cause the game controller 101 to implement the present invention will be stored in the memory 103.

The game controller 101 may include hardware credit meters 104 for the purposes of regulatory compliance and also include an input/output (I/O) interface 105 for communicating with the peripheral devices of the gaming machine 100. The input/output interface 105 and/or the peripheral devices may be intelligent devices with their own memory for instructions and data.

In the example shown in FIG. 2, the peripheral devices that communicate with the controller are the displays 106, input devices in the form of a bank of buttons/touch screen 107 and the card and/or ticket reader 108, the printer 109, a bill acceptor and/or coin input 110 and a coin output 111. Additional devices may be included as part of the gaming machine 100, or devices omitted as required for the specific implementation.

The bank of buttons 107A and/or touch screen 107B together with one or both of the displays 106 may provide a user interface 115 through which the gaming machine 100 and player communicate. If a card/ticket reader 108 is provided, this may also form part of the user interface 115.

In addition, the gaming machine 100 may include a communications interface, for example a network card 112. The network card 112, may for example, send status information, accounting information or other information to a central controller, server or database and receive data or commands from the central controller, server or database. The network card 112 may also enable communication with a central player account, allowing cashless gaming. One or more of the peripheral devices, for example the card/ticket reader 108 may be able to communicate directly with the network card 112. The network card 112 and the I/O interface 105 may be suitably implemented as a single machine communications interface.

The game controller 101 may also include a random number generator 113, which generates a series of random numbers that are used by the computational device 102 to determine the outcomes of games played on the gaming machine 100.

The game controller 101 may have distributed hardware and software components that communicate with each other directly or through a network or other communication channel. The game controller 101 may also be located in part or in its entirety remote from the user interface 115. Also, the computational device 102 may comprise a plurality of devices, which may be local or remote from each other.

Figure 3:
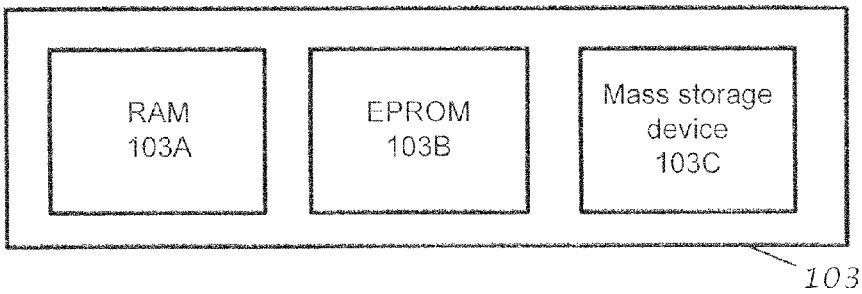
FIG. 3: shows a block diagram of components of the memory of the gaming machine represented in FIG. 2.

FIG. 3 shows an exemplary block diagram of the main components of the memory 103. The RAM 103A typically temporarily holds instructions and data related to the execution of game programs and communication functions performed by the computational controller 102. The EPROM 103B may be a boot ROM device and/or may contain system and game related code. The mass storage device 103C may be used to store game programs, the integrity of which may be verified and/or authenticated by the computational controller 102 using protected code from the EPROM 103B or elsewhere.

Figure 4:
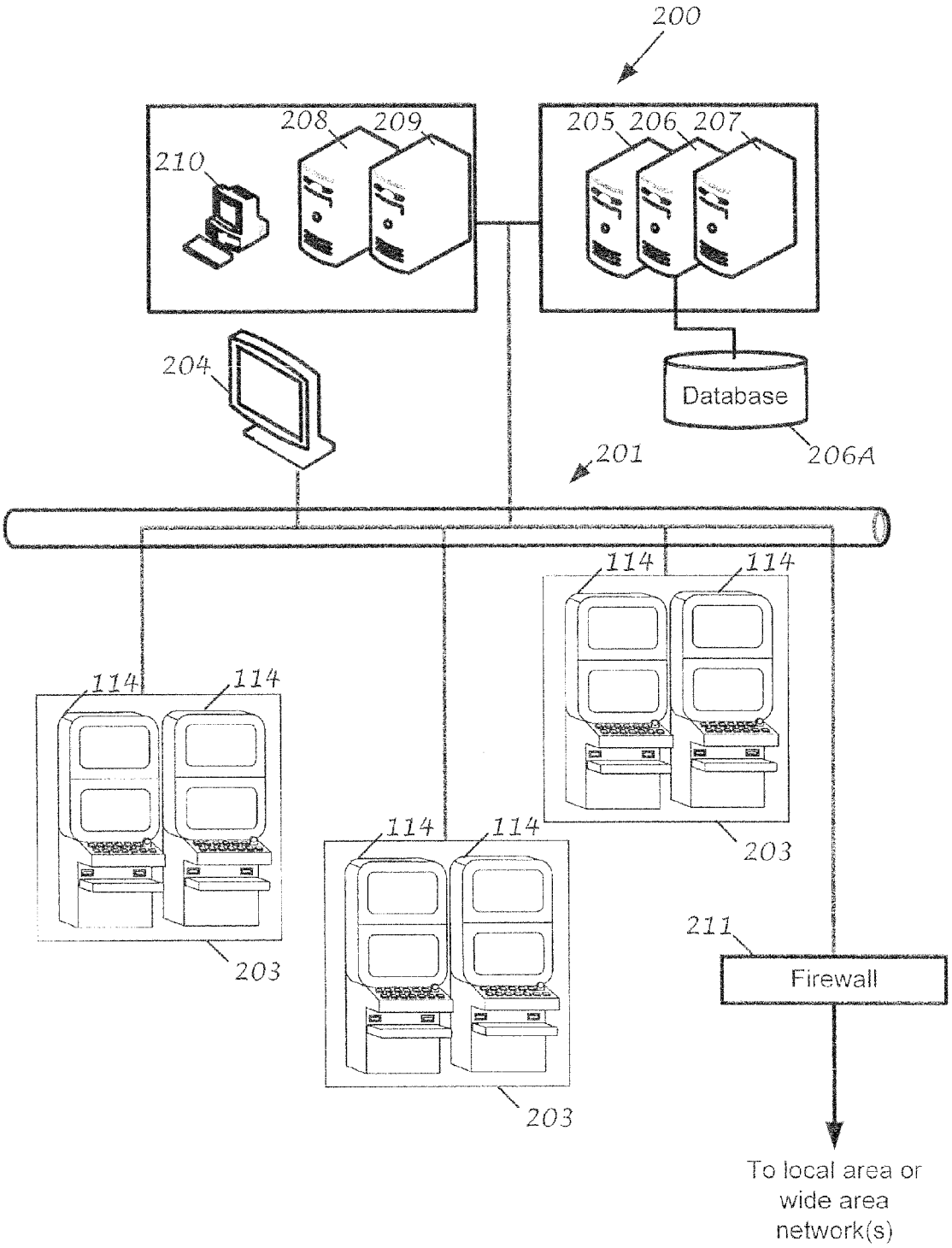
FIG. 4: shows diagrammatically, a network gaming system suitable for implementing certain embodiments of the present invention.

FIG. 4 shows a gaming system 200 in the form of a network of devices. The gaming system 200 includes a network infrastructure 201, which for example may be in the form of an Ethernet network. Alternatively, a wireless network and/or direct communication channels, or a different type of network may be used to link the gaming machines to a server, each other and/or other devices. Gaming consoles 114, shown arranged in three banks 203 of two gaming consoles 114 in FIG. 4, are connected to the network infrastructure 201. The gaming consoles 114 may form part or all of a gaming machine 100. Single gaming consoles 114 and banks 203 containing three or more gaming consoles 114 may also be connected to the network infrastructure 201, which may also include bank controllers, hubs, routers, bridges to other networks and other devices (not shown).

One or more displays 204 may also be connected to the network 201. The displays 204 may, for example, be associated with a bank 203 of gaming consoles 114. The displays 204 may be used to display representations associated with game play on the gaming consoles 114, and/or used to display other representations, for example promotional or informational material.

Servers may also be connected to the network 201. For example, a game server 205 may generate game outcomes for games played on one or more of the gaming consoles 114, a database management server 206 may manage the storage of game programs and associated data in a database 206A so that they are available for downloading to, or access by, game controllers 101, and a jackpot server 207 may control one or more jackpots for the gaming system 200.

Further servers may be provided to assist in the administration of the gaming system 200, including for example a gaming floor management server 208, and a licensing server 209 to monitor the use of licenses to particular games. An administrator terminal 210 is provided to allow an administrator to manage the network 201 and the devices connected to the network. The different servers depicted can be distinct physical servers or logically distinct server processes running on a single physical server.

The gaming system 200 may communicate with other gaming systems, other local networks, for example a corporate network and/or a wide area network such as the Internet through a firewall 211.

INDIVIDUAL MACHINE EMBODIMENT

This embodiment may be implemented by a standalone gaming machine 100, for example a gaming machine including the gaming console 114 shown in FIG. 1, with the game controller 101 located within the console 114 and this implementation is assumed for the description of this embodiment below. This embodiment may also be performed by a linked gaming machine, for example a gaming machine including one of the consoles 114 shown in FIG. 4, with the game controller 101 located within the console 114 or formed in whole or in part by the game server 205.

The gaming machine 100 provides a game, which may be a spinning reel game, card game, bingo game, keno game or other type of game. Methods for providing such games on a gaming machine 100 are well known and therefore will not be described in detail herein.

The game controller 101 of the gaming machine 100 is programmed with information to randomly determine an eligibility criterion for an award. When the gaming machine 100 determines that an award is available, the gaming machine 100 provides information to the player reporting the selected eligibility criterion and the award that will be awarded if the eligibility criterion is achieved. This information may be displayed on one or both the displays 106A and 106B.

The game controller 101 determines from game play activity on the gaming machine when the eligibility criterion has been achieved. Different eligibility criteria may have different probabilities of occurrence. When the eligibility criterion for the feature has been achieved, the gaming machine 100 awards the player the award. The game controller 101 also deactivates the eligibility criterion for the award and randomly determines what the next eligibility criterion will be.

The award can have many formats including but not limited to: the right to play a feature to be eligible for a special prize or a progressive prize; a series of free games; a series of games in which new prize patterns are defined; a second screen feature game; a series of games in which new prize values are defined; and a prize, for example a fixed number of credits, which may be a large prize in comparison to most or all of the other prizes available on the pay table of the gaming machine 100, or a non-cash prize. The feature may also be a combination of these features, for example an award of a prize in credits, followed by the award of series of free games in which new prize patterns are defined, with one possible outcome from the series of free games being an outcome that awards a special prize, which may be a progressive prize. The following description of an example implementation assumes that the award is a progressive prize.

The eligibility criterion can have many formats including but not limited to: achieving a pattern of symbols; achieving a set of outcomes; achieving a particular special symbol; and reaching a mystery trigger amount based on turnover on the gaming machine.

Because the selection of the eligibility criterion is random, it is possible to have the same eligibility criterion selected in two consecutive rounds of award of the feature. Alternatively, the selection may be controlled so that it is not possible for the same criterion to be selected twice in row. In one embodiment, the selection may be without replacement, so that the selection process cycles through all possible eligibility criteria.

Example Implementation

Figure 5:
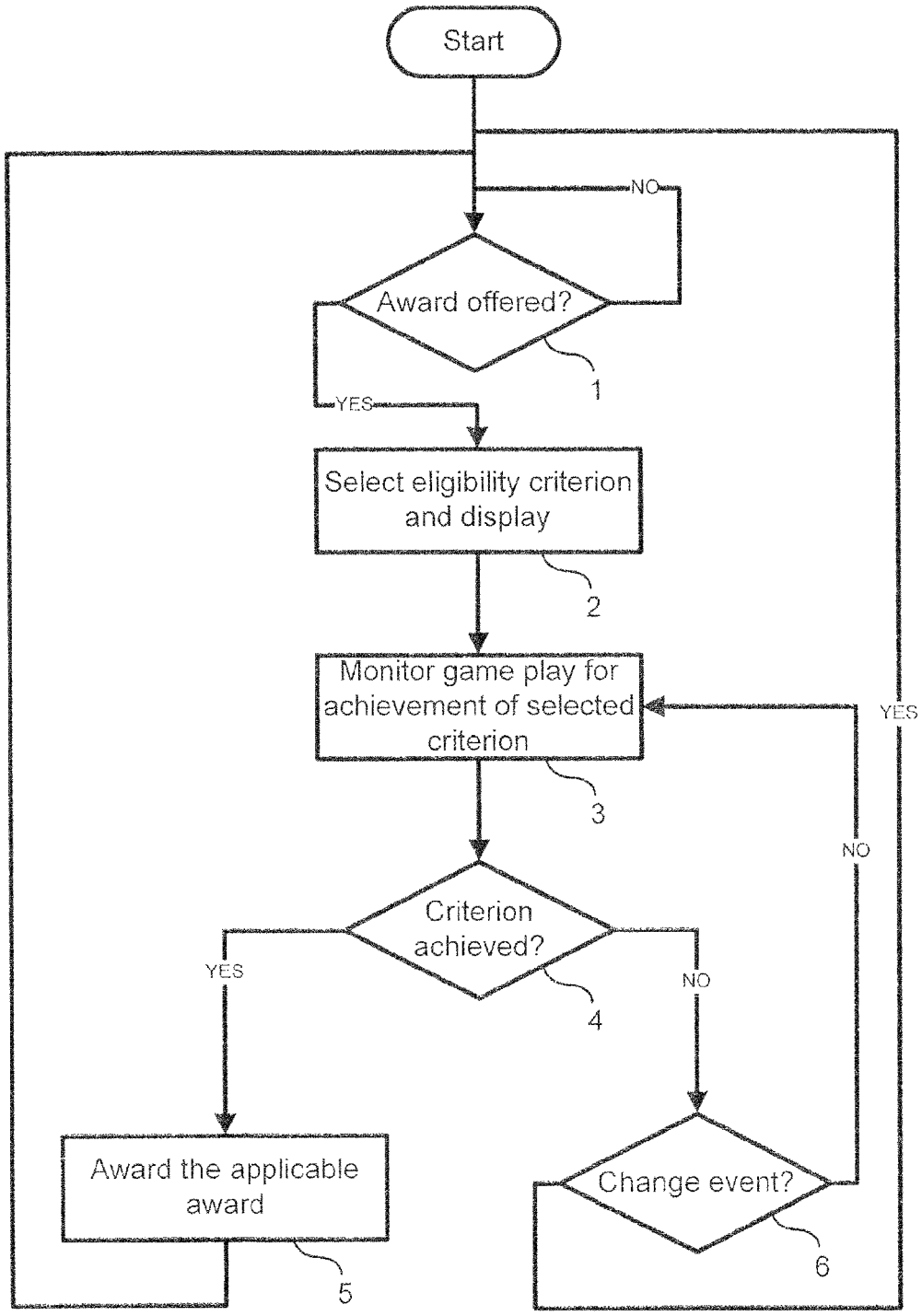
FIG. 5: shows a flow diagram of a process performed in accordance with an embodiment of the present invention.

A specific example implementation of this embodiment will now be described with reference to the flow diagram shown in FIG. 5.

The gaming machine 100 provides a game, which may for example be a spinning reel game in which symbols are displayed on a display 106 and if a winning combination, as determined by the game controller based on inputs from the RNG 113 occurs, the gaming machine awards an award according to a pay table. The game may include a base game and one or more feature games, which may be implemented as a same screen or different screen feature game. In addition, the gaming machine 100 stores in the memory 103 a definition of a plurality of different eligibility criteria for a feature and an award to be awarded if the selected criterion is achieved.

In step 1, the gaming machine 100 determines whether a bonus award is to be offered. The bonus award is the award that is awarded as a result of the process of the invention and is termed a bonus award to distinguish it from the awards that can result from play of the spinning reel game. This step allows control over the timing of the offering of a chance to win the award. For example the award may be offered only during certain promotional periods, or only after a certain delay period has elapsed following the previous award of the award. Alternatively, the award may only be offered when a certain trigger event occurs during play of the spinning reel game, for example the display on the revealed part of the reels of a certain combination of symbols.

In an alternative embodiment, the decision of step 1 may be omitted, in which case the bonus award is always offered.

In step 2, the game controller 101 randomly selects an eligibility criterion from the eligibility criteria stored in the memory 103 and causes information reporting the selection to be displayed to the player. For example, the gaming machine 100 may randomly select that the eligibility is the occurrence of three "crown" symbols anywhere on the centre line and report this to the player by displaying a message "3 crowns pays a 15 free game feature".

The player plays the gaming machine 100 (step 3) and in time the three "crowns" are shown on the centre line. The gaming machine 100 determines that an outcome that displays three crowns has occurred (step 4) and then completes step 5 by advising the player that the feature is awarded, by suitable representations on the display 106 and allowing the player to play the awarded feature game, including payment of the resulting prize (or prizes) from the feature game.

Once the feature has been awarded, the gaming machine 100 optionally waits a delay period (step 1) and then randomly selects another eligibility criterion for the feature game and advertises this to the player (step 2). The previously selected eligibility criterion is discarded. For example, the game machine 100 may in the second selection select that the eligibility is the sequence '9, 10 jack' left to right anywhere in the window. The process may then continue to cycle through steps 1 to 5.

In one implementation of this embodiment, the selected eligibility criterion may change due to an event other than the achievement of the currently selected eligibility criterion. In this implementation, if following step 4 it is determined that the criterion has not been achieved, then in decision step 6 the game controller 101 determines whether a change event has occurred. The change event may be the elapsing of a certain time period, for example one hour since the currently eligibility criterion was selected. Using this ability, a limited duration promotional period may be offered that ends after an hour regardless of whether an award has been awarded or regardless of how long the current eligibility criterion has been offered.

In another embodiment, the change event may be a change in wager placed by the player. In this other embodiment, the player may have to stake an ante-bet to be eligible to win the feature. In a still further embodiment, different features and/or sets of eligibility criteria may be available for different wagers.

Linked Gaming Machine Embodiment

This embodiment is implemented with linked gaming machines that interact with each other so that, in contrast to the individual gaming machine embodiment, the award process for one gaming machine is dependent in part on the activities of the other gaming machines. The following description assumes that the linked gaming machines 100 include the consoles 114 shown in FIG. 4. However, other methods of linking the gaming machines may be used, as the system merely needs to be able to send and receive messages to each of the machines.

The gaming machines 100 in the gaming system 200 and possibly also gaming machines in other gaming systems, can be nominated to form a "group". The group may comprise all of the gaming machines 100 in the gaming system 200, or a sub-set of those gaming machines. The selection of a sub-set may be according to which machines are compatible with the method, and/or according to desired group formations. For example, a group of friends may want to form a group so that they know that they are all trying to achieve the same eligibility criterion. The system can identify the group from a player identifier provided at the gaming consoles 114, for example the insertion of a player card into the card reader 108. Alternatively, players may have to 'qualify' to become a member of the group, for example by achieving a certain outcome during play of a game on a gaming machine 100, by wagering a certain amount in a certain time period, or by being a member of a predefined eligibility group.

A selecting device in the system is then used to randomly determine the eligibility criterion for which a feature game is available for each machine in the group. The selecting device could be any device in the system, including a game controller 101 of one or more of the gaming machines 100. In one embodiment, the game controller 101 of each gaming machine 100 could use its own RNG 113 to make the selection. However, a convenient implementation is to have a central device select the eligibility criterion and communicate it to the gaming machines 100.

The first gaming machine 100 to meet the eligibility requirements for the feature game wins the right to the feature game. The first machine to meet the eligibility requirements sends a message to the system which sends a message to all the other machines that the feature game is no longer available. The process is then repeated.

The various possible award trigger events need not have the same probability of occurrence. In addition, a single award trigger event may have a different probability of occurrence on different machines. While this may create inequity in the short term, this may be balanced in the long term to provide a fair result for all gaming machines, for example by providing a mix of award trigger events so that the total return to player of the award process is approximately equal for all gaming machines, and/or that the total return to player when a base game return to player is combined with the return to player of the award process of the present invention is approximately equal between gaming machines.

In addition, the award trigger events may be weighted, so that some are selected more or less often than others. Weighting may be used to achieve a fair balance between gaming machines.

Weighting may also be used to reflect different probabilities of occurrence of the award trigger events. For example, an award trigger event that occurs often during play of games on the gaming machines may be weighted so as to be selected less often. Weighting in this manner may also be used for the individual gaming machine embodiment.

The gaming system may simultaneously maintain a plurality of groups of gaming machines and treat each group separately by separately selecting eligibility criteria for each group and monitoring for satisfaction of the selected criteria in that group.

Example Implementation

Figure 6:
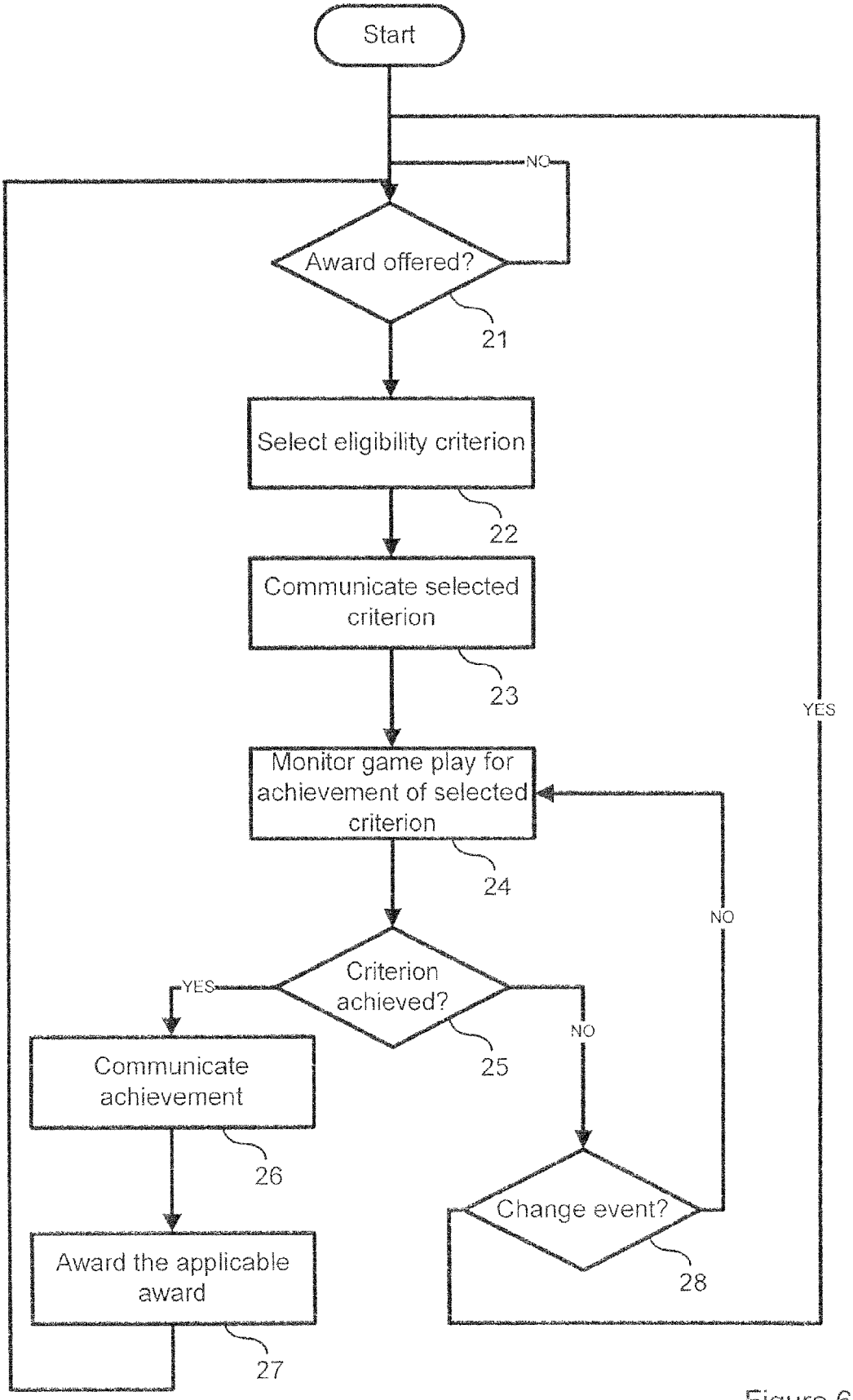
FIG. 6: shows a flow diagram of a process performed in accordance with another embodiment of the present invention.

A specific example implementation of this embodiment will now be described with reference to the flow diagram shown in FIG. 6.

Each of the gaming machine 100 in the group provides a game and operates in this respect in the same way as the gaming machines in the individual machine embodiment.

Each gaming machine 100 in the group may offer the same game, or different games. During play of the game on each of the gaming machines 100, the gaming machines report game play to the jackpot server 207 (see FIG. 4). The jackpot server 207 increases a progressive jackpot dependent on the reported game play. For example, the progressive jackpot may be increased by 2% of all wagers placed on the linked gaming machines 100. In this example the progressive jackpot is the award that is awarded when the selected eligibility criterion is achieved.

In this example, the jackpot server 207 is also the device that selects when the progressive jackpot is able to won (step 21) and what the eligibility criterion for winning the progressive jackpot is (step 22). For instance, the jackpot server 207 might determine that a feature is awarded to the first machine to show three Jacks left to right.

In step 23, the jackpot server 207 communicates to each of the linked gaming machines 100 that the progressive jackpot will be awarded to the first machine to show three Jacks left to right. Each gaming machine 100 in turn communicates a message to the player that the first machine to show three jacks left to right will be awarded a feature.

Each gaming machine 100 is played (step 24) and when a gaming machine 100 shows three jacks (step 25), it sends a message to the jackpot server 207 (step 26). The jackpot server 207 determines if this is the first machine to send the message and confirms eligibility to the gaming machine 100 that sent the message and reports the value of the progressive jackpot. The jackpot server 207 also notifies all the other linked gaming machines 100 that the progressive prize is no longer available and the linked gaming machines 100 in turn communicate this to their players, for example by removing the communication from a display. The gaming machine 100 that sent the message and received confirmation then awards the progressive prize, for example by printing a ticket using the printer 109 (step 27). The gaming machine 100 sends a message to the jackpot server 207 when the award of the progressive prize has been completed. The jackpot server 207 would then, as is typical for progressive jackpots, reset the progressive jackpot to a seed value.

The jackpot server 207 now determines when the progressive jackpot is next available, and randomly determines new eligibility criteria for a feature and sends the message to the linked gaming machines 100. For example, the progressive jackpot may only become available after the jackpot reaches a certain minimum level. The jackpot server 207 might then determine that the progressive prize is awarded to the first machine to show three scattered wild symbols and then the process will continue to cycle through steps 21 to 27.

As with the individual gaming machine embodiment, events other than achievement of the eligibility criterion may trigger a change in the eligibility criterion. Accordingly, the method may include step 28, which operates in the same way as step 6 described herein with reference to FIG. 5.

FURTHER EMBODIMENTS

The award trigger event may, as described in the above examples, consist of a single criterion, for example the occurrence of a particular combination of symbols during game play. The award trigger may instead consist of a plurality of criteria. Various possible options exist for the award trigger. One option is the achievement of a certain number of a particular combination of symbols. For example, a gaming machine 100 may need to accumulate four instances of three Jacks left to right to achieve the award trigger. This combination of criteria may be grouped as one possible selection option, or separated into two selection processes, one for the number of instances that need to be accumulated and another for the symbol or symbol combination to be accumulated. Accordingly, different possible award triggers may have different probabilities of occurrence.

The award that is awarded when the award trigger event occurs may be variable. For example, the gaming machine 100 or jackpot server 207 may maintain a pool of possible awards, for example an award of a feature game, the award of a fixed prize in credits, and eligibility to win a jackpot. The gaming machine 100 or jackpot server 207 may then select both the prize and the award trigger event. The possible award trigger events may be the same for each of the possible awards. Alternatively, the selection of one may influence what is available to be selected for the other. For example, the selection of a feature game as the award may result in the selection of an award trigger event from one set of possible events, whereas the selection of a fixed prize in credits may result in the selection of an award trigger event from another set of possible events. Using this, the probability of occurrence of the award trigger event may be related to the value of the award that has been selected.

The selected award may vary according to a predetermined pattern. For example, the award may change every hour, rotating between a group of two or more awards. Alternatively, the selected award may be selected in a random selection process. In another alternative the award may be manually specified by the gaming venue or system operator. In embodiments where the player must stake an ante-bet or place another specific wager to be eligible to win the selected award, a change in the ante-bet may cause a reselection of the award, which may use aspects of the previously described selection process. For example, a first wager may result in the random selection from a first group of awards, whereas a second wager may result in the random selection from a second group of awards.

The set of possible award trigger events that can be selected may also be variable. The variation may again be according to a pattern, according to a random selection process, or by manual input. In addition, the selection of an award trigger event may result in that award trigger event being deemed unavailable for selection in the next selection. This may continue until all possible award trigger events have been selected. The set of possible award trigger events that can be selected may be variable dependent on the placing a specific wager by the player. This variability may be in addition to, or instead of any variation of the selectable awards that is based on the staking of a particular wager.

While the foregoing description has been provided by way of example of the preferred embodiments of the present invention as presently contemplated, which utilise gaming machines of the type found in casinos, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

The invention claimed is:

1. A gaming machine comprising:

a game controller comprising a computational device and data storage in communication with the computational device; and a user interface comprising at least one display and one or more input devices in communication with the game controller to facilitate play of a game at the gaming machine;

wherein the data storage includes a definition of a plurality of possible eligibility criteria, each defining a winning outcome of the game that may occur during play of the game on the gaming machine;

wherein the game controller selects, using a random selection process, one or more of the plurality of possible eligibility criteria to thereby define at least one active award trigger event associated with an active award, and displays information on a display at the gaming machine identifying the selected eligibility criteria, and wherein the game controller further monitors play of the game on the gaming machine for occurrence of the active award trigger event and, in response to a predefined change event occurring before the active award trigger event, the game controller selects, using the random selection process, a new one or more of the plurality of possible eligibility criteria; wherein the game controller delays the selection for a delay period following occurrence of the predefined change event; and wherein when the active award trigger event occurs, the game controller causes the gaming machine to award the active award.

2. The gaming machine of claim 1 wherein the predefined change event comprises an event selected from the group of:

a time-based event, the occurrence of which is dictated according to either determinative or random criteria;

receipt by the game controller of a predefined command from a networked device; or a combination thereof.

3. The gaming machine of claim 1 wherein in different selections of one or more of the plurality of possible eligibility criteria to define the at least one active award trigger event, the selection is made from different sets of possible eligibility criteria.

4. The gaming machine of claim 1 wherein the predetermined change event that the variation is one or more of:

the elapsing of a certain period of time;

the provision by the player of a particular wager; or receipt of a change input at an operator interface of a device, separate from the gaming machine, in direct or indirect communication with the gaming machine.

5. The gaming machine of claim 1 wherein the active award is a special prize selected from the group comprising a progressive prize, a non-cash prize and a large prize.

6. The gaming machine of claim 1 wherein different ones of the plurality of possible eligibility criteria have different probabilities of occurrence.

7. A gaming system comprising a plurality of linked gaming machines, each gaming machine comprising a communication interface for communicating with the gaming system, and a game controller and a user interface for providing a game in which a plurality of symbols are selected and presented on a display of the user interface and if a winning combination occurs, the gaming machine awards an award, wherein the gaming system further comprises an award controller that selects, using a random selection process, one or more of a plurality of possible eligibility criteria each defining at least one possible combination of the plurality of symbols corresponding to a winning outcome of the game, and communicates the selected eligibility criteria to the game controller of each of the linked gaming machines where information identifying the selected eligibility criteria is displayed, the selected one or more eligibility criteria defining an active award trigger event associated with an active award, and wherein the game controller monitors play of the game for the occurrence of the active award trigger event, and, in response to a predefined change event occurring before the active award trigger event, the award controller selects, using a random selection process, a new one or more of the plurality of possible eligibility criteria, wherein the game controller delays the selection for a delay period following occurrence of the predefined change event; and in response to the occurrence of the active award trigger event, the game controller controls the communication interface to send a notice of the occurrence of the active award trigger event to the gaming system.

8. The gaming system of claim 7 wherein the notice is received by the award controller, which then communicates a second notice to each of the linked gaming machines.

9. The gaming system of claim 7 wherein the predefined change event is selected from the group of:

a time-based event, the occurrence of which is dictated according to either determinative or random criteria;

receipt by the game controller or award controller of a predefined command; or a combination thereof.

10. The gaming system of claim 7 wherein in different selections of one or more of the plurality of possible eligibility criteria, the selection is made from different sets of possible eligibility criteria.

11. The gaming system of claim 10 wherein a change between the different sets of possible eligibility criteria occurs in a predetermined pattern or includes at least a component that is varied randomly.

12. The gaming system of claim 7 wherein the predetermined change event comprises one or more of:

the elapsing of a certain period of time;

the occurrence of a change of the active trigger event based on game activity of the gaming machine;

the provision by the player of a particular wager; or receipt of a change input at an operator interface of a device in direct or indirect communication with the gaming machine.

13. The gaming system of claim 7 wherein a feature game that operates over a plurality of game events is awarded in response to the occurrence of the active award trigger.

14. The gaming system of claim 7 wherein a special prize selected from the group comprising a progressive prize, a non-cash prize and a large prize is awarded in response to the occurrence of the active award trigger.

15. The gaming system of claim 7 wherein different occurrences of the active award trigger event result in awards that vary for the different occurrences.

16. The gaming system of claim 7 wherein different ones of the plurality of possible eligibility criteria have different probabilities of occurrence.

* * * * *

UNITED STATES PATENT AND TRADEMARK OFFICE

CERTIFICATE OF CORRECTION

PATENT NO. : 8,523,661 B2
APPLICATION NO. : 12/118467
DATED : September 3, 2013
INVENTOR(S) : Claudio Daniel Dias Pires It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1117 days.

Signed and Sealed this
Twenty-third Day of May, 2017

Michelle K. Lee

Michelle K. Lee
*Director of the United States Patent and Trademark Office*